US005912204A

United States Patent [19]

Yamada et al.

[11] Patent Number: 5,912,204

[45] Date of Patent: Jun. 15, 1999

[54] THERMOSENSITIVE RECORDING ADHESIVE LABEL

[75] Inventors: Morio Yamada, Numazu; Masanaka Nagamoto, Susono; Toshinobu Iwata, Oyama; Hiroyuki Kaya, Aikawa, all of Japan

[73] Assignee: Ricoh Company, Ltd., Tokyo, Japan

[21] Appl. No.: 08/828,367

[22] Filed: Mar. 28, 1997

[30] Foreign Application Priority Data

| | | | |
|---|---|---|---|
| Mar. 28, 1996 | [JP] | Japan | 8-099148 |
| Mar. 28, 1996 | [JP] | Japan | 8-099149 |
| Mar. 28, 1996 | [JP] | Japan | 8-099150 |
| May 27, 1996 | [JP] | Japan | 8-154969 |

[51] Int. Cl.[6] ..... B41M 5/40

[52] U.S. Cl. ..... 503/200; 427/152; 503/226

[58] Field of Search ..... 427/150–152; 503/200, 226

[56] References Cited

U.S. PATENT DOCUMENTS

| | | | |
|---|---|---|---|
| 4,590,497 | 5/1986 | Shibata et al. | 503/201 |
| 4,777,079 | 10/1988 | Nagamoto et al. | 428/212 |
| 4,851,383 | 7/1989 | Fickenscher et al. | 503/200 |
| 5,053,267 | 10/1991 | Ide et al. | 428/195 |
| 5,110,389 | 5/1992 | Hiyoshi et al. | 156/234 |
| 5,248,543 | 9/1993 | Tamaguchi et al. | 428/195 |

FOREIGN PATENT DOCUMENTS 579430 1/1994 European Pat. Off. .

OTHER PUBLICATIONS

Patent Abstracts of Japan, vol. 97, No. 10, Abstract of JP 9–150576.

Patent Abstracts of Japan, vol. 18, No. 244, Abstract of JP 6–027882.

*Primary Examiner*—Bruce H. Hess

*Attorney, Agent, or Firm*—Oblon, Spivak, McClelland, Maier & Neustadt, P.C.

[57] ABSTRACT

A thermosensitive recording adhesive label has a support, a thermosensitive coloring layer provided on one side of the support, and a thermosensitive adhesive layer which is formed on the other side of the support, opposite to the side of the thermosensitive coloring layer with respect to the support, and is adhesive above room temperature, with the thermosensitive coloring layer having a surface smoothness of 200 to 10,000 sec when measured by the method of Ohken-shiki prescribed in Japan Tappi No. 5, and the thermosensitive adhesive layer having a surface smoothness of 60 to 3,000 sec in terms of Bekk's smoothness.

9 Claims, No Drawings

THERMOSENSITIVE RECORDING ADHESIVE LABEL

BACKGROUND OF THE INVENTION

FIELD OF THE INVENTION

The present invention relates to a thermosensitive recording adhesive label comprising a support, a thermosensitive coloring layer formed on the front side of the support, and a thermosensitive adhesive layer without being provided with a liner (i.e., a disposable backing sheet), which is formed on the back side of the support and is not adhesive at room temperature and is heat-activated so as to become adhesive by the application of heat thereto. Namely, the present invention relates to a so-called liner-less thermosensitive recording adhesive label.

DISCUSSION OF BACKGROUND

Recently, a thermosensitive recording adhesive label has been used in a wide variety of fields, for example, in the system of Point of Sales (POS). However, such a conventional thermosensitive recording adhesive label still has many shortcomings.

To be more specific, in the above-mentioned label, a pressure-sensitive adhesive layer or a room-temperature adhesive layer is provided on one side of a support with a liner (i.e., disposable backing sheet) being attached to the adhesive layer, and on the other side of the support a thermosensitive coloring layer is provided.

The conventional thermosensitive recording label is commercially available in such a fashion that the label portions are separately arranged and attached to a liner sheet, or the thermosensitive recording label is entirely attached to the liner sheet so as to detach a necessary portion on a perforated line. In any case, to use such a thermosensitive recording adhesive label, it is necessary to release a necessary portion from the liner, and thereafter the liner must be discarded. Therefore, from the ecological viewpoint, consideration must be given to the problem of waste disposal.

In addition, the liner is relatively voluminous and heavy, so that a large space is required during the storage of the label and the transportation of the label becomes a factor. Namely, although the liner is to be discarded at the final step, it must be attached to the adhesive layer of the label immediately before the recording label is used.

To solve the above-mentioned problems, there are proposed recording labels without a liner, that is, liner-less thermosensitive recording adhesive labels. For instance, as disclosed in Japanese Laid-Open Utility Model Applications 59-43979 and 59-46265 and Japanese Laid-Open Patent Application 60-54842, the following is considered. It is proposed to employ a pressure-sensitive adhesive in microcapsule form in the adhesive layer, and to provide a releasing agent layer on the top layer such as a protective layer, in light of the storage of the thermosensitive recording adhesive label in the form of a roll. According to the above-mentioned conventional proposals, however, the adhesion of the pressure-sensitive adhesive layer is not sufficient, and it is impossible to print an image on the surface of the label when the releasing agent layer is overlaid. These proposals have not yet been put to practical use.

Furthermore, there is proposed a method of employing a thermosensitive adhesive in the adhesive layer of the thermosensitive recording adhesive label, as disclosed in Japanese Laid-Open Utility Model Application 54-12446.

The above-mentioned conventional thermosensitive recording adhesive label employing the thermosensitive adhesive is very useful, but it has the drawback that when the recording label is stored in roll form for a long period of time, the blocking phenomenon occurs. Even though no thermal energy is applied to the thermosensitive adhesive layer, the blocking phenomenon may occur because of the pressure due to the weight of the roll. To prevent this, it is necessary to decrease the strength of the adhesive in the thermosensitive adhesive layer.

Furthermore, as disclosed in Japanese Laid-Open Patent Application 63-303387 and Japanese Utility Model Publication 5-11573, it is proposed that, in a liner-less thermosensitive recording adhesive label, an intermediate layer such as an expandable insulating layer or non-expandable insulating layer be added so as to activate the thermosensitive adhesive layer efficiently. Such a liner-less thermosensitive recording adhesive label, provided with the intermediate layer, is superior to the one without the intermediate layer because the thermosensitive adhesive layer can be more efficiently activated by the application of a small amount of thermal energy, and therefore, there can be employed a thermosensitive adhesive which is heat-activated at high temperature.

However, there is no liner-less thermosensitive recording adhesive label that can satisfy both situations simultaneously; sufficient adhesiveness and blocking resistance.

SUMMARY OF THE INVENTION

It is therefore a first object of the present invention to provide a thermosensitive recording adhesive label which can exhibit strong adhesiveness to a member to which the recording adhesive label is attached, using a thermosensitive adhesive with strong adhesiveness, and which does not induce the blocking phenomenon when stored in the roll form.

A second object of the present invention is to provide a thermosensitive recording adhesive label which can show excellent image reliability regardless of a plasticizer contained in the thermosensitive adhesive layer.

The above-mentioned objects of the present invention can be achieved by a thermosensitive recording adhesive label comprising a support, a thermosensitive coloring layer provided on one side of the support, and a thermosensitive adhesive layer which is formed on the other side of the support, opposite to the side of the thermosensitive coloring layer with respect to the support, and is adhesive above room temperature, the surface of the thermosensitive coloring layer having a surface smoothness of 200 to 10,000 sec when measured by the method of Ohken-shiki prescribed in Japan Tappi No. 5, and the surface of the thermosensitive adhesive layer having a surface smoothness of 60 to 3,000 sec in terms of Bekk's smoothness.

DESCRIPTION OF THE PREFERRED EMBODIMENTS

The inventors of the present invention have investigated the problems of the conventional thermosensitive recording adhesive label. In particular, special attentions have been paid to the fact that the blocking phenomenon occurs while a liner-less thermosensitive recording adhesive label is stored in the roll form so as to bring the thermosensitive adhesive layer into contact with the thermosensitive coloring layer. As a result of the intensive studies on the relation between the surface characteristics of the thermosensitive adhesive layer and those of the thermosensitive coloring layer, the inventors of the present invention have discovered that the blocking phenomenon can be effectively prevented when the surface smoothnesses of the thermosensitive adhesive layer and the thermosensitive coloring layer which are in contact with each other during the storage are controlled to specified values.

Generally, to heat-activate the thermosensitive adhesive layer of the liner-less thermosensitive recording adhesive label, the thermal energy is applied to the side of the thermosensitive coloring layer or the side of the thermosensitive adhesive layer, or the adhesive label is placed into a temperature-controlled bath. In any case, when the thermal energy for activating the thermosensitive adhesive layer is too strong, the color development will take place in the background of the thermosensitive coloring layer.

Therefore, in the course of heat-activation for the thermosensitive adhesive layer, it is required to apply the thermal energy to the label to such a degree that the color development may not occur in the background portion of the thermosensitive coloring layer. In this case, however, the thermosensitive adhesive layer cannot be provided with sufficient adhesiveness when the surface smoothness of the thermosensitive adhesive layer is too low. On the other hand, when the surface smoothness of the thermosensitive adhesive layer is too high, the blocking resistance is decreased while the adhesive label is stored in the roll form.

Further, when the surface smoothness of the thermosensitive coloring layer is too low, the thermal sensitivity of the thermosensitive coloring layer is lowered; and when the surface smoothness of the thermosensitive coloring layer is too high, the blocking resistance is also decreased while the adhesive label is stored in the roll form.

In the present invention, to simultaneously obtain desired adhesiveness of the thermosensitive adhesive layer, sufficient resistance to the blocking phenomenon between the thermosensitive coloring layer and the thermosensitive adhesive layer, and high thermal sensitivity of the thermosensitive coloring layer, the surface smoothness of the thermosensitive coloring layer is specified to 200 to 10,000 sec, preferably 500 to 4,000 sec when measured by the method of Ohken-shiki prescribed in Japan Tappi No. 5. When the surface smoothness of the thermosensitive coloring layer is less than 200 sec, the thermal sensitivity is decreased. When the surface smoothness thereof exceeds 10,000 sec, the blocking resistance is decreased during the storage of the adhesive label in the roll form.

Further, the surface smoothness of the thermosensitive adhesive layer is specified to 60 to 3,000 sec, preferably 100 to 2,000 sec in terms of Bekk's smoothness. When the surface smoothness of the thermosensitive adhesive layer is less than 60 sec, the thermosensitive adhesive cannot be efficiently heat-activated. When the surface smoothness thereof exceeds 3,000 sec, the blocking resistance is decreased during the storage of the adhesive label in the roll form.

The smoothness of the thermosensitive coloring layer is measured using a smoothness tester of Ohken-shiki prescribed in Japan Tappi No. 5. To be more specific, a sample of the thermosensitive recording adhesive label is placed on a measuring head with the thermosensitive coloring layer being directed to the head, a load is applied to the sample, and the scale mark of a scale plate corresponding to the height of a manometer is read after the value of the manometer is stabilized (about two minutes).

With respect to the smoothness of the thermosensitive adhesive layer, the smoothness is measured using a Bekk's smoothness tester. In the case where air of 10 ml takes 300 seconds or less to pass through the gap between a sample film of the thermosensitive adhesive layer and a glass plate, the time (second) required for the mercury column to decrease by 20 mm may be measured. In the case where it takes 300 seconds or more, the time (second) required for the mercury column to decrease by 2 mm is measured, and then the obtained value may be increased by ten times in accordance with Japanese Industrial Standard (JIS) P8119.

The above specified smoothness of the thermosensitive adhesive layer can be obtained, for example, by adjusting the particle size of a solid plasticizer to be added to the thermosensitive adhesive layer, and subjecting the obtained thermosensitive adhesive layer to calendering after drying.

The thermosensitive coloring layer can be provided with the previously specified smoothness, for example, by adjusting the particle size of the components contained in the thermosensitive coloring layer, controlling the water content of the thermosensitive coloring layer, and subjecting the obtained thermosensitive coloring layer to calendering after drying.

The thermosensitive adhesive for use in the thermosensitive adhesive layer comprises:

- a polymeric resin which is provided with adhesiveness by the application of heat thereto;
- a plasticizer which assumes a solid state at room temperature (hereinafter referred to as a solid plasticizer), and is melted by the application of heat thereto so as to make the polymeric resin adhesive; and
- a tackifier for further strengthening the adhesiveness when necessary.

The polymeric resin for use in the thermosensitive adhesive is not particularly limited in the present invention, but the following polymeric resins can be preferably employed: polyvinyl acetate, polybutyl methacrylate, vinyl ether-vinylidene chloride copolymer, synthetic rubber, vinyl acetate-2-ethylhexyl acrylate copolymer, vinyl acetate-ethylene copolymer, vinyl pyrrolidone-styrene copolymer, styrene-butadiene copolymer, vinyl pyrrolidone-ethyl acrylate copolymer, and acryl-butadiene copolymer.

Of these polymeric resins, an acryl-butadiene copolymer is particularly preferable in the present invention. To prepare such an acryl-butadiene copolymer, the following acryl monomers can be used as copolymerizable monomers with butadiene: methacrylic ester such as methyl methacrylate (MMA), methacrylic acid, acrylic ester, acrylic acid, acrylonitrile, acrylamide, and N-methylolacrylamide.

Of the thus obtained acryl-butadiene copolymers, methyl methacrylate (MMA)-butadiene copolymer is further preferably employed because the obtained thermosensitive adhesive shows strong adhesiveness to any adherend, especially to vinyl chloride wraps and polyethylene wraps, and sufficient blocking resistance can be obtained.

Further, when the above-mentioned methyl methacrylate (MMA)-butadiene copolymer is used in combination with a styrene-acryl copolymer, the adhesiveness to the adherend is further improved, and the blocking resistance is also further improved. To prepare such a styrene-acryl copolymer, the following acryl monomers can be used as copolymerizable monomers with styrene: methacrylic ester, methacrylic acid, acrylic ester, acrylic acid, acrylonitrile, acrylamide, and N-methylolamide.

In such a case, it is preferable that the amount ratio by weight of the acryl-butadiene copolymer to the styrene-acryl copolymer be in the range of (1:0.2) to (1:5), more preferably in the range of (1:0.3) to (1:3). When the amount ratio of the acryl-butadiene copolymer to the styrene-acryl copolymer is within the above range, the blocking resistance of the obtained thermosensitive adhesive layer is satisfactory and the adhesiveness to vinyl chloride wraps or polyethylene wraps is sufficient.

Examples of the solid plasticizer for use in the thermosensitive adhesive are as follows: diphenyl phthalate, dihexyl phthalate, dicyclohexyl phthalate, dihydroabietyl phthalate, dimethyl isophthalate, sucrose benzoate, ethylene glycol dibenzoate, trimethylolethane tribenzoate, glyceride tribenzoate, pentaerythritol tetrabenzoate, sucrose octacetate, tricyclohexyl citrate, and N-cyclohexyl-p-toluenesulfonamide.

It is preferable that the amount of the solid plasticizer in the thermosensitive adhesive be in the range of 30 to 70 wt. %, more preferably in the range of 35 to 65 wt. %, of the total weight of the thermosensitive adhesive. When the content of the solid plasticizer is within the above-mentioned range, sufficient adhesion can be obtained.

Examples of the tackifier for use in the thermosensitive adhesive are as follows: rosin and derivatives thereof, for example, polymerized rosin, hydrogenated rosin, esters of the above-mentioned rosin such as glycerin and pentaerythritol, and dimers of resin acid; terpene resin; petroleum resin; phenolic resin; and xylene resin.

It is preferable that the melting point or the softening point of the above-mentioned tackifier be 100° C. or more, more preferably in the range of 100 to 200° C. When the melting point or softening point of the tackifier is 100° C. or more, the blocking resistance of the obtained thermosensitive recording adhesive label does not decrease.

It is preferable that the amount of tackifier be in the range of 3 to 30 wt. %, and more preferably 5 to 25 wt. % of the total weight of the thermosensitive adhesive. When the amount of tackifier is within the above-mentioned range, the decrease of adhesiveness and the decrease of blocking resistance can be prevented.

In the present invention, the thermosensitive recording adhesive label may further comprise a barrier layer which is provided between the support and the thermosensitive adhesive layer and/or between the support and the thermosensitive coloring layer so as not to allow the activated thermosensitive adhesive to penetrate through the support and enter the thermosensitive coloring layer. Thus, the effective amount of thermosensitive adhesive can be maintained and the plasticizer contained in the thermosensitive adhesive layer can be prevented from penetrating into the thermosensitive coloring layer.

It is preferable that the barrier layer for use in the present invention have an air permeability of 10,000 sec or more, and more preferably 20,000 sec or more, when measured by the method of Ohken-shiki prescribed in Japan Tappi No. 5. When the air permeability of the barrier layer is 10,000 sec or more, the barrier effect against the plasticizer contained in the thermosensitive adhesive layer is more significant.

The air permeability of the barrier layer can be controlled to 10,000 sec or more by selecting the resin and other additives to be contained in the barrier layer, and adjusting the thickness of the barrier layer. Thus, the preferable deposition amount of a coating liquid for formation of the barrier layer is about 0.5 g/m$^2$ or more on a dry basis.

The barrier layer comprises a resin and other additives.

Any resins that have film-forming properties are available for the formation of the barrier layer. Specific examples of the resin for the formation of the barrier layer are as follows: emulsions of styrene-butadiene copolymer, styrene-butadiene-acryl copolymer, vinyl acetate resin, vinyl acetate-acrylic acid copolymer, styrene-acrylic ester copolymer, acrylic ester resin, and polyurethane resin; latexes of SBR, MBR, and NBR; and water-soluble polymeric resins such as polyvinyl alcohol, cellulose derivative, starch and derivatives thereof, carboxyl-group-modified polyvinyl alcohol, polyacrylic acid and derivatives thereof, styrene-acrylic acid copolymer and derivatives thereof, poly (meth)acrylamide and derivatives thereof, styrene-acrylic acid-acrylamide copolymer, amino-group-modified polyvinyl alcohol, epoxy-modified polyvinyl alcohol, polyethyleneimine, and isobutylene-maleic anhydride copolymer and derivatives thereof.

The above-mentioned barrier layer may further comprise a filler. Examples of such a filler include finely-divided particles of inorganic fillers such as calcium carbonate, silica, zinc oxide, titanium oxide, aluminum hydroxide, zinc hydroxide, barium sulfate, clay, talc, and surface-treated calcium and silica; and finely-divided particles of organic fillers such as urea-formaldehyde resin, styrene-methacrylic acid copolymer, and polystyrene resin.

In light of the effect of preventing the peeling of the thermosensitive adhesive layer and the thermosensitive coloring layer, it is preferable that the barrier layer comprise any of the above-mentioned water-soluble polymeric resins and a waterproofing agent.

As the waterproofing agent for use in the barrier layer, there can be employed water-soluble resins, for example, polyamide epichlorohydrin, aziridine alkyl ester, melamine, and glycerin glycidyl ether.

Furthermore, the thermosensitive recording adhesive label may further comprise a heat insulating layer which is interposed between the support and the thermosensitive coloring layer and/or between the support and the thermosensitive adhesive layer. By provision of the insulating layer between the support and the thermosensitive coloring layer, the thermal energy applied by a heating element such as a thermal head can be efficiently utilized, so that the coloring sensitivity of the thermosensitive coloring layer is improved. Owing to the heat insulating layer between the support and the thermosensitive adhesive layer, the thermosensitive adhesive layer can be efficiently heat-activated. Thus, it is possible to widen the difference between the heat-activation temperature of the thermosensitive adhesive layer and the color development initiation temperature of the thermosensitive coloring layer.

In the present invention, there can be employed an insulating layer comprising minute void particles with a voidage of 30% or more, each comprising a thermoplastic resin for forming a shell. Non-expandable or expandable fillers can be used for forming the minute void particles.

The non-expandable minute void particles for use in the insulating layer, which are in an expanded state, contain air or other gases therein. It is preferable to employ the minute void particles with an average particle size of 0.4 to 20 $\mu$m, more preferably 0.5 to 10 $\mu$m, and further preferably 3 to 8 $\mu$m. When the average particle diameter (outer diameter) of the minute void particles is 0.4 $\mu$m or more, void particles with a desired voidage can be produced with no difficulty. When the average particle diameter (outer diameter) of the minute void particles is 20 $\mu$m or less, the surface smoothness of the obtained insulating layer is not so lowered that the matching properties of the thermosensitive coloring layer with the thermal head are satisfactory. Accordingly, the decrease of dot-reproduction performance and thermal sensitivity can be avoided. It is also preferable that the above-mentioned minute void particles be classified in a uniform particle size spectrum.

The voidage of the minute void particles for use in the insulating layer is preferably 30% or more, and more preferably 50% or more. When the insulating layer interposed between the support and the thermosensitive coloring layer has a voidage of 30% or more, sufficient insulating properties can be obtained. Therefore, the thermal energy for color development of the thermosensitive coloring layer, which is generated, for example, by a thermal head, can be efficiently utilized in the thermosensitive coloring layer without escaping through the support, thereby improving the coloring sensitivity. In addition, due to the insulating layer between the support and the thermosensitive adhesive layer, the thermal energy applied to the thermosensitive adhesive layer for heat-activation can be efficiently used in the thermosensitive adhesive layer, so that sufficient adhesion can be exhibited.

The voidage of minute void particles means a ratio of the inner diameter to the outer diameter of void particles, which is expressed by the following formula:

$$\text{Voidage}(\%) = \frac{(\text{inner diameter of void particles})}{(\text{outer diameter of void particles})} \times 100$$

The minute void particles comprise a thermoplastic resin for forming a shell therefor, as previously mentioned. As the above-mentioned thermoplastic resin, a copolymer resin comprising as the main components vinylidene chloride and acrylonitrile is preferably employed.

To provide the non-expandable insulating layer on the support, the above-mentioned minute void particles may be dispersed in water together with a binder agent such as a conventionally known water-soluble polymer or an aqueous polymer emulsion so as to prepare a coating liquid for the formation of the insulating layer. The coating liquid thus prepared may be coated on the support and dried, so that an insulating layer is provided on the support. In such a case, it is preferable that the deposition amount of the minute void particles be at least 1 g/m$^2$, and more preferably in the range of about 2 to 15 g/m$^2$. The binder agent for use in the coating liquid for the non-expandable insulating layer may be in such an amount that can stably bind the insulating layer to the support, and in general, the amount of binder agent may be in the range of 2 to 50 wt. % of the total weight of the minute void particles and the binder agent.

When the expandable filler is used for formation of the expandable insulating layer, there can be employed plastic void filler particles, each comprising a thermoplastic resin for forming a shell therefor and a blowing agent such as a low boiling point solvent therein. Those void plastic filler particles are expanded by the application of heat thereto. Such an expandable plastic filler is conventionally known. It is preferable that the particle size of the expandable plastic filler be in the range of 2 to 50 $\mu$m, and more preferably 5 to 20 $\mu$m in a non-expanded state; and in the range of 10 to 100 $\mu$m, and more preferably 10 to 50 $\mu$m in an expanded state.

Examples of the thermoplastic resin for forming the shell for the expandable plastic filler particles are polystyrene, polyvinyl chloride, polyvinylidene chloride, polyvinyl acetate, polyacrylate, polyacrylonitrile, polybutadiene and copolymers comprising monomers constituting the above-mentioned resins.

As the blowing agent, propane or butane is generally employed.

When such an expandable insulating layer is provided on the support, a mixture of the above-mentioned expandable plastic filler and a binder agent is coated on the support and dried, and thereafter the plastic filler may be caused to blow with the application of heat thereto by bringing a heated plate into contact with the surface of the coated layer.

It is preferable that the deposition amount of the plastic filler be at least 1 g/m$^2$, and more preferably about 2 to 5 g/m$^2$ in a non-expanded state. The binder agent may be added to the plastic filler in such an amount that can firmly bind the obtained expandable insulating layer to the support. In general, the amount of binder agent is in the range of 5 to 50 wt. % of the total weight of the non-expanded plastic filler and the binder agent. The blowing temperature of the plastic filler is a softening point of the thermoplastic resin constituting the shell of the plastic filler particles. It is preferable that the blowing magnification be 2 to 4 times, and more preferably 2 to 3 times.

The surface of the obtained insulating layer of an expanded type is considerably rough, so that it is preferable to subject the insulating layer to surface treatment by calendering after expanding the plastic filler particles by the application of heat thereto. When necessary, at least one undercoat layer may be provided over the obtained insulating layer. Such an undercoat may also be provided under the insulating layer.

The above-mentioned insulating layer may further comprise auxiliary additives which are conventionally used in this kind of thermosensitive recording material, for example, a thermofusible material and a surfactant. The same thermofusible materials for use in the thermosensitive coloring layer, which will be described later, are usable in the insulating layer.

For the formation of the insulating layer comprising the minute void particles, the conventional water-soluble polymers and/or aqueous polymer emulsions are used as the binder agents.

Examples of the above-mentioned water-soluble polymers are polyvinyl alcohol, starch and derivatives thereof, cellulose derivatives such as methoxy cellulose, hydroxy cellulose, carboxymethyl cellulose, methyl cellulose and ethyl cellulose, sodium polyacrylate, polyvinyl pyrrolidone, acrylamide-acrylic ester copolymer, acrylamide-acrylic ester-methacrylic acid terpolymer, alkali salts of styrene-maleic anhydride copolymer, alkali salts of isobutylene-maleic anhydride copolymer, polyacrylamide, sodium alginate, gelatin, and casein.

Examples of the aqueous polymer emulsions for use in the insulating layer include latexes of styrene-butadiene copolymer and styrene-butadiene-acrylic copolymer; and emulsions of vinyl acetate resin, vinyl acetate-acrylic acid copolymer, styrene-acrylic ester copolymer, acrylic ester resin, and polyurethane resin.

The above-mentioned barrier layer and the heat insulating layer may be simultaneously provided between the support and the thermosensitive coloring layer and/or between the support and the thermosensitive adhesive layer. The barrier layer and the insulating layer may be overlaid on the support in any order. In the case where both layers are interposed between the support and the thermosensitive coloring layer, it is preferable to provide on the support in such an order of the barrier layer, the insulating layer and the thermosensitive coloring layer. This is because the thermal energy applied to the thermosensitive coloring layer for color development can be more efficiently used.

In light of the structure of the layers for practical use, it is preferable that the insulating layer and the thermosensitive coloring layer be successively provided on the front side of the support and the barrier layer and the thermosensitive adhesive layer be successively provided on the back side of the support. Alternatively, it is preferable that the barrier layer, the insulating layer and the thermosensitive coloring layer be provided on the front side of the support, and the thermosensitive adhesive layer be provided on the back side of the support.

The thermosensitive coloring layer comprises a coloring composition which can induce color formation by the application of heat thereto. For instance, the above-mentioned coloring composition comprises a coloring agent such as a leuco dye, and a color developer.

As the leuco dye for use in the present invention, which may be employed alone or in combination, any conventional dyes for use in the conventional leuco-dye-containing recording materials can be employed. For example, triphenylmethane leuco compounds, fluoran leuco compounds, phenothiazine leuco compounds, auramine leuco compounds, spiropyran leuco compounds, and indolinophthalide leuco compounds are preferably employed. Specific examples of those leuco dyes are as follows:

3,3-bis(p-dimethylaminophenyl)phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-di-n-butylamino-7-(o-chloroanilino)fluoran,
3-N-methyl-N,n-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-(N-ethyl-N-tetrahydrofurfuryl)amino-6-methyl-7-anilinofluoran,
3-N-ethyl-N-(2-ethoxypropyl)amino-6-methyl-7-anilinofluoran,
3-N-methyl-N-isobutyl-6-methyl-7-anilinofluoran,
3-morphorino-7-(N-propyl-trifluoromethylanilino)fluoran,
3-pyrrolidino-7-m-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)fluoran,
3-(N-methyl-N-isopropylamino)-6-methyl-7-anilinofluoran,
3-di-n-butylamino-6-methyl-7-anilinofluoran,
3,6-bis(dimethylamino)fluorenespiro(9,3')-6'-dimethylaminophthalide,
3-(N-benzyl-N-cyclohexylamino)-5,6-benzo-7-α-naphthylamino-4'-bromofluoran,
3-diethylamino-6-chloro-7-anilinofluoran,
3-diethylamino-6-methyl-7-mesidino-4',5'-benzofluoran,
3-N-methyl-N-isopropyl-6-methyl-7-anilinofluoran,
3-N-ethyl-N-isoamyl-6-methyl-7-anilinofluoran, and
3-diethylamino-6-methyl-7-(2',4'-dimethylanilino)fluoran.

As the color developer for use in the thermosensitive coloring layer, there can be employed a variety of electron-acceptor compounds and oxidizing agents which are capable of inducing color formation in the above-mentioned leuco dyes when coming in contact with the leuco dyes under application of heat thereto.

Specific examples of the color developer for use in the present invention are as follows:

4,4'-isopropylidenediphenol,
4,4'-isopropylidenebis(o-methylphenol),
4,4'-sec-butylidenebisphenol,
4,4'-isopropylidenebis(2-tert-butylphenol),
zinc p-nitrobenzoate,
1,3,5-tris(4-tert-butyl-3-hydroxy-2,6-dimethylbenzyl)isocyanuric acid,
2,2-(3,4'-dihydroxydiphenyl)propane,
bis(4-hydroxy-3-methylphenyl)sulfide,
4-[β-(p-methoxyphenoxy)ethoxy]salicylic acid,
1,7-bis(4-hydroxyphenylthio)-3,5-dioxaheptane,
1,5-bis(4-hydroxyphenylthio)-5-oxapentane,
monocalcium salt of monobenzyl phthalate,
4,4'-cyclohexylidenediphenol,
4,4'-isopropylidenebis(2-chlorophenol),
2,2'-methylenebis(4-methyl-6-tert-butylphenol),
4,4'-butylidenebis(6-tert-butyl-2-methyl)phenol,
1,1,3-tris(2-methyl-4-hydroxy-5-tertbutylphenyl)butane,
1,1,3-tris(2-methyl-4-hydroxy-5-cyclohexylphenyl)butane,
4,4'-thiobis(6-tert-butyl-2-methyl)phenol,
4,4'-diphenolsulfone,
4-isopropoxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
stearyl gallate,
lauryl gallate,
octyl gallate,
1,3-bis(4-hydroxyphenylthio)propane,
N,N'-diphenylthiourea,
N,N'-di(m-chlorophenyl)thiourea,
salicylanilide,
bis(4-hydroxyphenyl)methyl acetate,
bis(4-hydroxyphenyl)benzyl acetate,
1,3-bis(4-hydroxycumyl)benzene,
1,4-bis(4-hydroxycumyl)benzene,
2,4'-diphenolsulfone,
2,2'-diallyl-4,4'-diphenolsulfone,
3,4-dihydroxyphenyl-4'-methyldiphenylsulfone, zinc 1-acetyloxy-2-naphthoate,
zinc 2-acetyloxy-1-naphthoate,
zinc 2-acetyloxy-3-naphthoate,
α,α-bis(4-hydroxyphenyl)-α-methyltoluene,
antipyrine complex of zinc thiocyanate,
tetrabromobisphenol A,
tetrabromobisphenol S,
4,4'-thiobis(2-methylphenol), and
4,4'-thiobis(2-chlorophenol).

Those color developers may be used alone or in combination.

In the thermosensitive coloring layer, it is preferable that the amount of the color developer be one to 20 parts by weight, more preferably 2 to 10 parts by weight, to one part by weight of the coloring agent.

The thermosensitive coloring layer may further comprise a binder resin. Particularly, binder resins having a hydroxyl group or carboxyl group in a molecule thereof are preferably employed.

Specific examples of the above-mentioned binder resin for use in the thermosensitive coloring layer are polyvinyl butyral, polyvinyl acetal such as polyvinyl acetoacetal, cellulose derivatives such as ethyl cellulose, cellulose acetate, cellulose acetate propionate and cellulose acetate butyrate, and epoxy resin. Those binder resins can be used alone or in combination.

The thermosensitive coloring layer is provided on the support in such a manner that the coloring agent, color developer and binder resin are uniformly dispersed or dissolved in an organic solvent to prepare a coating liquid, and the coating liquid thus prepared is coated on the support and dried. In this case, the coating method is not particularly limited.

It is preferable that the size of the particles dispersed in the coating liquid for the thermosensitive coloring layer be 10 μm or less, more preferably 5 μm or less, and further preferably 1 μm or less.

The thickness of the thermosensitive coloring layer, which depends on the formulation for the thermosensitive coloring layer and the application of the obtained thermosensitive recording adhesive label, is preferably in the range of about 1 to 50 μm, and more preferably about 3 to 20 μm.

In order to improve the coating characteristics of the thermosensitive coloring layer coating liquid and upgrading the coloring characteristics of the obtained thermosensitive coloring layer, the thermosensitive coloring layer coating liquid may further comprise auxiliary additive components such as a filler, a surfactant, a lubricant and an agent for preventing color formation by pressure application, which are used in the conventional thermosensitive recording materials.

Examples of the filler for use in the thermosensitive coloring layer are finely-divided particles of inorganic fillers such as calcium carbonate, silica, zinc oxide, titanium oxide, aluminum hydroxide, zinc hydroxide, barium sulfate, clay, kaolin, talc, and surface-treated calcium and silica; and finely-divided particles of organic fillers such as urea-formaldehyde resin, styrene-methacrylic acid copolymer, polystyrene resin and vinylidene chloride resin.

Examples of the lubricant for use in the thermosensitive coloring layer are higher fatty acids and metallic salts thereof, higher fatty amides, higher fatty acid esters, and a variety of waxes such as an animal wax, a vegetable wax, a mineral wax and a petroleum wax.

For the support of the thermosensitive recording adhesive label according to the present invention, there can be employed not only a sheet of paper; but also a film made of a polyester such as polyethylene terephthalate or polybutylene terephthalate, a cellulose derivative such as cellulose triacetate, a polyolefin such as polypropylene or polyethylene, or a polystyrene. Further, a laminated material of the above-mentioned films is usable.

The thermosensitive coloring layer may further comprise a protective layer, which is provided at the top position. When the protective layer is overlaid, the surface of the protective layer has a smoothness of 200 to 10,000 sec when measured by the method of Ohken-shiki prescribed in Japan Tappi No. 5.

The protective layer for use in the present invention is considered to be important in light of the improvement of the chemical resistance, water resistance, wear resistance, light resistance and head-matching properties of the obtained label.

The protective layer for use in the present invention may be a film comprising as the main component a water-soluble resin or hydrophobic resin, or a film comprising as the main component an ultraviolet-curing resin or electron-beam curing resin.

Examples of the water-soluble resin for use in the protective layer are polyvinyl alcohol, modified polyvinyl alcohol, cellulose derivatives such as methyl cellulose, methoxy cellulose and hydroxy cellulose, casein, gelatin, polyvinyl pyrrolidone, styrene-maleic anhydride copolymer, diisobutylene-maleic anhydride copolymer, polyacrylamide, modified polyacrylamide, methyl vinyl ether-maleic anhydride copolymer, carboxyl-modified polyethylene, polyvinyl alcohol-polyacrylamide block copolymer, melamine-formaldehyde resin, and urea-formaldehyde resin.

Examples of the resin for an aqueous emulsion and the hydrophobic resin for use in the protective layer include polyvinyl acetate, polyurethane, styrene-butadiene copolymer, styrene-butadiene-acrylic copolymer, polyacrylic acid, polyacrylic ester, vinyl chloride-vinyl acetate copolymer, polybutyl methacrylate, polyvinyl butyral, polyvinyl acetal, ethyl cellulose, and ethylene-vinyl acetate copolymer. Further, a copolymer comprising a monomer constituting the above-mentioned resins and a silicone segment may also be preferably employed. Those resins may be used alone or in combination. When necessary, the resin may be cured using a curing agent.

The ultraviolet-curing resin for use in the protective layer is prepared by polymerizing a monomer, oligomer or prepolymer which is polymerizable to form a cured resin by the application of ultraviolet light thereto. There are no limitations on such a monomer, oligomer or prepolymer for the preparation of the ultraviolet-curing resin for use in the protective layer, but conventional monomers, oligomers, or prepolymers can be employed.

There are no particular limitations on the electron-beam curing resin for use in the protective layer. An electron-beam curing resin comprising a polyester skeleton with a five or more functional branched molecular structure, and a silicone-modified electron-beam curing resin are preferred in the present invention.

In order to further improve the matching properties of the obtained recording label to a thermal head, the protective layer may further comprise an inorganic and organic filler, and a lubricant so long as the surface smoothness of the protective layer is not decreased.

It is preferable that the particle size of the filler for use in the protective layer be 0.3 μm or less. Further, the oil absorption of the filler is preferably 30 ml/100 g or more, and more preferably, 80 ml/100 g or more.

The above-mentioned inorganic and organic filler for use in the protective layer, which may be used alone or in combination, can be selected from any pigments used in the conventional thermosensitive recording materials.

Specific examples of the inorganic pigment for use in the protective layer are calcium carbonate, silica, zinc oxide, titanium oxide, aluminum hydroxide, zinc hydroxide, barium sulfate, clay, talc, and surface-treated calcium and silica.

Specific examples of the organic pigment for use in the protective layer are urea-formaldehyde resin, styrene-methacrylic acid copolymer and polystyrene resin.

The protective layer may be provided by any of the conventional coating methods. It is preferable that the thickness of the protective layer be in the range of 0.1 to 20 $\mu$m, and more preferably in the range of 0.5 to 10 $\mu$m. When the thickness of the protective layer is within the above-mentioned range, the functions of the protective layer, that is, the improvements of preservation stability of the recording label and head-matching properties of the thermosensitive coloring layer can be sufficiently expected, and the decrease of thermal sensitivity of the thermosensitive coloring layer can be prevented.

Furthermore, in the thermosensitive recording adhesive label of the present invention, the thermosensitive adhesive layer and/or the intermediate layer (i.e. the heat insulating layer or the barrier layer) provided between the support and the thermosensitive adhesive layer may further comprise an infrared absorption material in order to activate the thermosensitive adhesive layer more efficiently by the exposure to halogen lamp or xenon lamp.

As the above-mentioned infrared absorption material, there can be employed organic or inorganic compounds which can show absorption peaks in the infrared region of 0.7 to 20 $\mu$m. In the present invention, carbon is preferably employed as the infrared absorption material.

To activate the thermosensitive adhesive layer of the thermosensitive recording adhesive label according to the present invention, a heat-application roller, hot plate, thermal head, heated air, and light application may be employed.

Further, a heat pen, thermal head and laser beam can be used for recording information in the thermosensitive coloring layer.

Other features of this invention will become apparent in the course of the following description of exemplary embodiments, which are given for illustration of the invention and are not intended to be limiting thereof.

EXAMPLE 1

Preparation of Thermosensitive Recording Adhesive Label

Formation of insulating layer

The following components were stirred and dispersed, so that a coating liquid for a non-expandable insulating layer was prepared:

| | Parts by Weight |
|---|---|
| Aqueous dispersion of minute void particles (copolymer resin comprising vinylidene chloride and acrylonitrile as the main components) (solid content: 32%, average particle diameter: 5 $\mu$m, and voidage: 92%) | 30 |
| Styrene - butadiene copolymer latex | 10 |
| Water | 60 |

The thus prepared insulating layer coating liquid was coated on a sheet of high quality paper with a basis weight of 80 g/m$^2$ serving as a support, and dried in such a fashion that the deposition amount of the coating liquid was 5 g/m$^2$ on a dry basis. Thus, a non-expandable insulating layer was provided on the support.

Formation of thermosensitive coloring layer

A mixture of the following components was separately dispersed and pulverized in a sand mill until the average particle size reached 2.0 $\mu$m or less, thereby obtaining a Liquid A and a Liquid B:

| | Parts by Weight |
|---|---|
| [Liquid A] | |
| 3-dibenzylamino-6-methyl-7-anilinofluoran | 20 |
| 10% aqueous solution of polyvinyl alcohol | 10 |
| Water | 70 |
| [Liquid B] | |
| 4,4'-dihydroxybenzophenone | 20 |
| 10% aqueous solution of polyvinyl alcohol | 10 |
| Calcium carbonate | 3 |
| Water | 67 |

One part by weigh of the Liquid A and four parts by weight of the Liquid B were mixed and stirred, so that a coating liquid C was prepared.

Then, a mixture of the following components was dispersed in a sand mill for one hour, so that a coating liquid D for the formation of a protective layer was prepared:

| | Parts by Weight |
|---|---|
| [Liquid D] | |
| Silica | 4 |
| 10% aqueous solution of itaconic-acid-modified polyvinyl alcohol (degree of saponification: 87 mol %) | 60 |
| 30% aqueous dispersion of zin stearate | 2 |
| 12.5% aqueous solution of polyamide epichlorohydrin | 20 |
| Water | 14 |

On the above obtained insulating layer, the coating liquid C was coated and dried in such a fashion that the deposition amount of the coating liquid C was 4 g/m$^2$ on a dry basis.

Thereafter, the coating liquid D was coated and dried in such a fashion that the deposition amount of the coating liquid D was 3 g/m$^2$ on a dry basis.

Thus, a thermosensitive coloring layer comprising a protective layer was provided on the insulating layer.

Then, the surface of the coated layer was subjected to a supercalendering treatment twice at a calendering speed of 15 m/min with the application of a load of 30 kg thereto so as to have a surface smoothness of 2,000 sec in accordance with the method of Ohken-shiki prescribed in Japan Tappi No. 5.

Formation of barrier layer

A mixture of the following components was stirred and dispersed, so that a barrier layer coating liquid was prepared:

| | Parts by Weight |
|---|---|
| 10% aqueous solution of polyvinyl alcohol | 50 |
| Aluminum hydroxide | 5 |
| 10% aqueous solution of polyamide epichlorohydrin | 20 |
| Water | 25 |

On the back side of the support, opposite to the side of the thermosensitive coloring layer with respect to the support, the barrier layer coating liquid was coated and dried in such a fashion that the deposition amount of the coating liquid was 3 g/m$^2$ on a dry basis.

Thus, a barrier layer was provided on the back side of the support. In this case, the air permeability of the obtained barrier layer was infinity (∞).

Formation of Thermosensitive Adhesive Layer

A mixture of the following components was dispersed in a ball mill until the particle diameter reached 3.0 μm or less, so that a thermosensitive adhesive layer coating liquid was prepared:

| | Parts by Weight |
|---|---|
| MMA - butadiene copolymer "2M-36" (Trademark), made by Takeda Chemical Industries, Ltd. (Solid content: 47.5%) | 16 |
| Styrene - acrylic copolymer "Polysol 4T-2040" (Trademark), made by Showa Highpolymer Co., Ltd. (Solid content: 40%) | 19 |
| Terpene resin (m. p. 120° C.) | 10 |
| Dicyclohexyl phthalate | 25 |
| Amine-based dispersant | 2 |
| Water | 28 |

On the above prepared barrier layer, the thermosensitive adhesive layer coating liquid was coated and dried in such a fashion that the deposition amount of the coating liquid was 20 g/m$^2$ on a dry basis.

Thus, a thermosensitive adhesive layer was provided on the barrier layer.

Further, the surface of the thermosensitive adhesive layer was subjected to a supercalendering treatment once at a calendering speed of 15 m/min with the application of a load of 10 kg thereto so as to have a smoothness of 600 sec in terms of Bekk's smoothness.

Thus, a thermosensitive recording adhesive label No. 1 according to the present invention was obtained.

EXAMPLE 2

The procedure for preparation of the thermosensitive recording adhesive label No. 1 in Example 1 was repeated except that the thermosensitive adhesive layer was subjected to a supercalendering treatment once at a calendering speed of 15 m/min with the application of a load of 20 kg thereto so as to have a smoothness of 2,500 sec in terms of Bekk's smoothness.

Thus, a thermosensitive recording adhesive label No. 2 according to the present invention was obtained.

EXAMPLE 3

The procedure for preparation of the thermosensitive recording adhesive label No. 1 in Example 1 was repeated except that the thermosensitive adhesive layer was subjected to a supercalendering treatment once at a calendering speed of 50 m/min with no load being applied thereto so as to have a smoothness of 80 sec in terms of Bekk's smoothness.

Thus, a thermosensitive recording adhesive label No. 3 according to the present invention was obtained.

EXAMPLE 4

The procedure for preparation of the thermosensitive recording adhesive label No. 1 in Example 1 was repeated except that the thermosensitive coloring layer was subjected to a supercalendering treatment once at a calendering speed of 15 m/min with the application of a load of 10 kg thereto so as to have a smoothness of 500 sec in accordance with the method of Ohken-shiki prescribed in Japan Tappi No. 5.

Thus, a thermosensitive recording adhesive label No. 4 according to the present invention was obtained.

EXAMPLE 5

The procedure for preparation of the thermosensitive recording adhesive label No. 1 in Example 1 was repeated except that the water content in the obtained thermosensitive recording adhesive label was slightly increased by adjusting the drying conditions so as to have a surface smoothness of the thermosensitive coloring layer of 8,000 sec in accordance with the method of Ohken-shiki prescribed in Japan Tappi No. 5.

Thus, a thermosensitive recording adhesive label No. 5 according to the present invention was obtained.

EXAMPLE 6

The procedure for preparation of the thermosensitive recording adhesive label No. 1 in Example 1 was repeated except that the coating liquid for the formation of the barrier layer in Example 1 was replaced by a Liquid E with the following formulation, and that the deposition amount of the thus prepared barrier layer coating liquid E was changed from 3 g/m$^2$ to 2.5 g/m$^2$ on a dry basis, and the air permeability of the obtained barrier layer was controlled to 8,000 sec.

| | Parts by Weight |
|---|---|
| [Liquid E] | |
| 10% aqueous solution of polyvinyl alcohol | 9 |
| 10% aqueous solution of polyamide epichlorohydrin | 3 |
| Aluminum hydroxide | 30 |
| Water | 58 |

Thus, a thermosensitive recording adhesive label No. 6 according to the present invention was obtained.

EXAMPLE 7

The procedure for preparation of the thermosensitive recording adhesive label No. 1 in Example 1 was repeated except that the barrier layer as employed in Example 1 was not provided on the back side of the support, so that a thermosensitive recording adhesive label No. 7 according to the present invention was obtained.

EXAMPLE 8

The procedure for preparation of the thermosensitive recording adhesive label No. 1 in Example 1 was repeated except that the non-expandable insulating layer as employed in Example 1 was not provided on the support, so that a thermosensitive recording adhesive label No. 8 according to the present invention was obtained.

EXAMPLE 9

The procedure for preparation of the thermosensitive recording adhesive label No. 1 in Example 1 was repeated except that the MMA-butadiene copolymer in an amount of 16 parts by weight used in the formulation for the thermosensitive adhesive layer coating liquid in Example 1 was replaced by the styrene-acrylic copolymer "Polysol 4T-2040" (Trademark), made by Showa Highpolymer Co., Ltd., so that a thermosensitive recording adhesive label No. 9 according to the present invention was obtained.

Comparative Example 1

The procedure for preparation of the thermosensitive recording adhesive label No. 1 in Example 1 was repeated except that the thermosensitive adhesive layer was not subjected to a supercalendering treatment so as to have a smoothness of 30 sec in terms of Bekk's smoothness.

Thus, a comparative thermosensitive recording adhesive label No. 1 was obtained.

Comparative Example 2

The procedure for preparation of the thermosensitive recording adhesive label No. 1 in Example 1 was repeated except that the thermosensitive adhesive layer was subjected to a supercalendering treatment once at a calendering speed of 15 m/min with the application of a load of 30 kg thereto so as to have a smoothness of 3,500 sec in terms of Bekk's smoothness.

Thus, a comparative thermosensitive recording adhesive label No. 2 was obtained.

Comparative Example 3

The procedure for preparation of the thermosensitive recording adhesive label No. 1 in Example 1 was repeated except that the water content of the obtained thermosensitive recording adhesive label was rather increased by adjusting the drying conditions so as to have a surface smoothness of the thermosensitive coloring layer of 15,000 sec in accordance with the method of Ohken-shiki prescribed in Japan Tappi No. 5.

Thus, a comparative thermosensitive recording adhesive label No. 3 was obtained.

Comparative Example 4

The procedure for preparation of the thermosensitive recording adhesive label No. 8 in Example 8 was repeated except that the thermosensitive coloring layer was subjected to a supercalendering treatment once at a calendering speed of 15 m/min with no load being applied thereto so as to have a smoothness of 150 sec in accordance with the method of Ohken-shiki prescribed in Japan Tappi No. 5.

Thus, a comparative thermosensitive recording adhesive label No. 4 was obtained.

EXAMPLE 10

Preparation of Thermosensitive Recording Adhesive Label

Formation of insulating layer

The following components were stirred and dispersed, so that a coating liquid for a non-expandable insulating layer was prepared:

| | Parts by Weight |
|---|---|
| Aqueous dispersion of minute void particles (copolymer resin comprising vinylidene chloride and acrylonitrile as the main components) (Solid content: 32%, average particle diameter: 5 μm, and voidage: 92%) | 30 |
| Styrene - butadiene copolymer latex | 10 |
| Water | 60 |

The thus prepared insulating layer coating liquid was coated on a sheet of high quality paper with a basis weight of 80 g/m$^2$ serving as a support, and dried in such a fashion that the deposition amount of the coating liquid was 5 g/m$^2$ on a dry basis. Thus, a non-expandable insulating layer was provided on the support.

Formation of thermosensitive coloring layer

A mixture of the following components was separately dispersed and pulverized in a sand mill until the average particle size reached 2.0 μm or less, thereby obtaining a Liquid F and a Liquid G:

| | Parts by Weight |
|---|---|
| [Liquid F] | |
| 3-dibenzylamino-6-methyl-7-anilinofluoran | 20 |
| 10% aqueous solution of polyvinyl alcohol | 20 |
| Water | 60 |
| [Liquid G] | |
| 4,4'-dihydroxybenzophenone | 10 |
| 10% aqueous solution of polyvinyl alcohol | 25 |
| Calcium carbonate | 15 |
| Water | 50 |

One part by weigh of the Liquid F and eight parts by weight of the Liquid G were mixed and stirred, so that a thermosensitive coloring layer coating liquid H was prepared.

On the above obtained insulating layer, the thermosensitive coloring layer coating liquid H was coated and dried in such a fashion that the deposition amount of the coating liquid was 5 g/m$^2$ on a dry basis.

Then, the surface of the coated layer was subjected to a supercalendering treatment once at a calendering speed of 15 m/min with the application of a load of 20 kg thereto so as to have a smoothness of 700 sec in accordance with the method of Ohken-shiki prescribed in Japan Tappi No. 5.

Formation of barrier layer

A mixture of the following components was stirred and dispersed, so that a barrier layer coating liquid was prepared:

| | Parts by Weight |
|---|---|
| 10% aqueous solution of polyvinyl alcohol | 50 |
| Aluminum hydroxide | 5 |
| 10% aqueous solution of polyamide epichlorohydrin | 20 |
| Water | 25 |

On the back side of the support, opposite to the side of the thermosensitive coloring layer with respect to the support, the barrier layer coating liquid was coated and dried in such a fashion that the deposition amount of the coating liquid was 3 g/m$^2$ on a dry basis.

Thus, a barrier layer was provided on the back side of the support. In this case, the air permeability of the obtained barrier layer was infinity (∞).

Formation of Thermosensitive Adhesive Layer

A mixture of the following components was dispersed in a ball mill until the particle diameter reached 3.0 μm or less, so that a thermosensitive adhesive layer coating liquid was prepared:

| | Parts by Weight |
|---|---|
| MMA - butadiene copolymer "2M-36" (Trademark), made by Takeda Chemical Industries, Ltd. (Solid content: 47.5%) | 16 |
| Styrene - acrylic copolymer "Polysol 4T-2040" (Trademark), made by Showa Highpolymer Co., Ltd. (Solid content: 40%) | 19 |
| Terpene resin (m. p. 120° C.) | 10 |
| Dicyclohexyl phthalate | 25 |
| Amine-based dispersant | 2 |
| Water | 28 |

On the above prepared barrier layer, the thermosensitive adhesive layer coating liquid was coated and dried in such a fashion that the deposition amount of the coating liquid was 20 g/m$^2$ on a dry basis.

Thus, a thermosensitive adhesive layer was provided on the barrier layer. Further, the surface of the thermosensitive adhesive layer was subjected to a supercalendering treatment once at a calendering speed of 15 m/min with the application of a load of 10 kg thereto so as to have a smoothness of 600 sec in terms of Bekk's smoothness.

Thus, a thermosensitive recording adhesive label No. 10 according to the present invention was obtained.

EXAMPLE 11

The procedure for preparation of the thermosensitive recording adhesive label No. 1 in Example 1 was repeated except that the coating liquid for the formation of the barrier layer in Example 1 was replaced by a Liquid I with the following formulation, and that the air permeability of the barrier layer was controlled to 15,000 sec.

| | Parts by Weight |
|---|---|
| [Liquid I] | |
| Silica | 10 |
| 10% aqueous solution of polyvinyl alcohol | 50 |
| Water | 40 |

Thus, a thermosensitive recording adhesive label No. 11 according to the present invention was obtained.

EXAMPLE 12

The procedure for preparation of the thermosensitive recording adhesive label No. 1 in Example 1 was repeated except that an insulating layer was further provided between the high quality paper serving as the support and the barrier layer by coating on the back side of the paper the same coating liquid as used for the formation of the insulating layer in Example 1, and drying the same.

In this case, the thermosensitive coloring layer was subjected to a supercalendering treatment twice at a calendering speed of 15 m/min with the application of a load of 30 kg thereto so as to have a smoothness of 2,000 sec when measured by the method of Ohken-shiki. The thermosensitive adhesive layer was subjected to a supercalendering treatment once at a calendering speed of 50 m/min with no load being applied thereto so as to have a smoothness of 80 sec in terms of Bekk's smoothness.

EXAMPLE 13

The procedure for preparation of the thermosensitive recording adhesive label No. 1 in Example 1 was repeated except that a barrier layer was further provided between the high quality paper serving as the support and the insulating layer by coating the same coating liquid as used for the formation of the barrier layer in Example 1 on the paper and drying the same.

In this case, the thermosensitive coloring layer was subjected to a supercalendering treatment twice at a calendering speed of 15 m/min with the application of a load of 30 kg thereto so as to have a smoothness of 2,000 sec when measured by the method of Ohken-shiki. The thermosensitive adhesive layer was subjected to a supercalendering treatment twice at a calendering speed of 15 m/min with the application of a load of 10 kg thereto so as to have a smoothness of 600 sec in terms of Bekk's smoothness.

Each of the thermosensitive recording adhesive labels No. 1 to No. 13 in Examples 1 to 13 and comparative thermosensitive recording adhesive labels No. 1 to No. 4 in Comparative Examples 1 to 4 was evaluated with respect to the following aspects:

(1) Dynamic coloring density of thermosensitive coloring layer

Each thermosensitive recording adhesive label was loaded in a thermosensitive printing test apparatus equipped with a commercially available thin film head (made by Matsushita Electronic Components Co., Ltd.), and images were thermally printed on the thermosensitive recording label under the conditions that the applied electric power was 0.45 W/dot, the period for one line was 4 msec/line and the scanning density was 8×7.7 dot/mm, with the pulse width changed to 0.4 msec and 0.5 msec.

The coloring density of the images recorded on the thermosensitive recording label was measured using a McBeth densitometer RD-914.

The results are shown in Table 1.

(2) Adhesiveness of thermosensitive adhesive layer by heat activation

The thermosensitive adhesive layer was activated in such a manner that the thermosensitive adhesive layer was exposed to a halogen lamp of 1350 W at an irradiation speed of 3 inch/sec, using a commercially available apparatus, "Transparency-Maker" (Trademark), made by Sumitomo 3M Limited.

The thus heat-activated thermosensitive adhesive layer of each adhesive label was attached to a vinyl chloride wrap. Then, the adhesiveness of the thermosensitive adhesive layer to the vinyl chloride wrap was evaluated on the following scale:

A: The adhesiveness was very strong and considered to be preferable in practical use.

B: The adhesiveness was sufficient and the thermosensitive recording adhesive label was acceptable in practical use.

C: The adhesiveness was weak, and the thermosensitive recording adhesive label was not acceptable in practical use.

The results are shown in Table 1.

(3) Blocking resistance

A couple of thermosensitive recording adhesive label samples were attached to each other in such a fashion that the thermosensitive adhesive layer of one sample was brought into contact with the thermosensitive coloring layer of the other sample. Those samples were allowed to stand at 40° C. and 90% RH under the application of a load of 2 kg/cm$^2$ for 24 hours.

24 hours later, the one sample was peeled from the other sample at room temperature, and the blocking resistance of the thermosensitive recording adhesive label after storage was evaluated on the following scale:

A: The blocking phenomenon was not recognized because there was no peeling sound.

B: The blocking phenomenon was not serious although there was a faint peeling sound.

C: The blocking phenomenon was partially recognized by the peeling sound.

The results are shown in Table 1.

(4) Plasticizer resistance

Images were thermally printed on each thermosensitive recording adhesive label using the above-mentioned thermosensitive printing test apparatus equipped with a commercially available thin film head (made by Matsushita Electronic Components Co., Ltd.) with the pulse width being set to 1.2 msec. Then, the thermosensitive adhesive layer was exposed to a halogen lamp with a power of 1350 W, using the commercially available apparatus "Transparency Maker" (Trademark), made by Sumitomo 3M Limited., to activate the thermosensitive adhesive layer.

The thus prepared thermosensitive recording adhesive label was attached to three laminated vinyl chloride wraps, "Polymer Wrap 300" (Trademark), made by Shin-Etsu Polymer Co., Ltd. The label was allowed to stand at 50° C. under the application of a load of 5 kg thereto for 48 hours. Thereafter, the image density of the images printed on the label was measured using a McBeth densitometer RD-914.

The results are shown in Table 1.

TABLE 1

| | Surface Smoothness (sec.) (*) | | Air permeability of Barrier | Adhesiveness (to vinyl | Dynamic Coloring Density | | | |
|---|---|---|---|---|---|---|---|---|
| | Thermosensitive coloring layer | Thermosensitive adhesive layer | Layer (sec.) (**) | chloride wrap) | 0.4 ms | 0.5 ms | Plasticizer Resistance | Blocking Resistance |
| Ex. 1 | 2000 | 600 | ∞ | A | 0.81 | 1.21 | 1.37 | A |
| Ex. 2 | 2000 | 2500 | ∞ | A | 0.82 | 1.22 | 1.36 | B |
| Ex. 3 | 2000 | 80 | ∞ | B | 0.81 | 1.22 | 1.37 | A |
| Ex. 4 | 500 | 600 | ∞ | A | 0.78 | 1.19 | 1.35 | A |
| Ex. 5 | 8000 | 600 | ∞ | A | 0.84 | 1.24 | 1.38 | B |
| Ex. 6 | 2000 | 600 | 8000 | A | 0.82 | 1.21 | 0.58 | A |
| Ex. 7 | 2000 | 600 | (–) | A | 0.81 | 1.22 | 0.31 | A |
| Ex. 8 | 2000 | 600 | ∞ | A | 0.64 | 1.04 | 1.35 | A |
| Ex. 9 | 2000 | 600 | ∞ | A | 0.81 | 1.21 | 1.36 | A |
| Comp. Ex. 1 | 2000 | <30 | ∞ | C | 0.81 | 1.22 | 1.37 | A |
| Comp. Ex. 2 | 2000 | >3500 | ∞ | A | 0.82 | 1.22 | 1.36 | C |
| Comp. Ex. 3 | >15000 | 600 | ∞ | A | 0.85 | 1.25 | 1.38 | C |
| Comp. Ex. 4 | <150 | 600 | ∞ | A | 0.37 | 0.87 | 1.35 | A |
| Ex. 10 | 700 | 600 | ∞ | A | 0.62 | 1.03 | 1.37 | A |
| Ex. 11 | 2000 | 600 | 15000 | A | 0.80 | 1.21 | 1.36 | A |
| Ex. 12 | 2000 | 80 | ∞ | A | 0.63 | 1.04 | 1.36 | A |
| Ex. 13 | 2000 | 600 | ∞ | A | 0.83 | 1.24 | 1.37 | A |

(*) The surface smoothness is not always the same under the same calendering conditions because it varies depending on the water content of the obtained label and the kind of calendering apparatus to be employed.
(**) The air permeability of the barrier layer is measured by the method of Ohken-shiki prescribed in Japan Tappi No. 5.

As can be seen from the results shown in Table 1, when the thermosensitive recording adhesive label according to the present invention is employed, the adhesiveness of the thermosensitive adhesive layer to the adherend surface such as a polyvinyl wrap is satisfactory, the coloring density of images thermally printed on the thermosensitive recording label is sufficient. Furthermore, the blocking resistance and the plasticizer resistance are also excellent during the storage in the roll form.

Japanese Patent Application No. 8-099148 filed Mar. 28, 1996, Japanese Patent Application No. 8-099149 filed Mar. 28, 1996, Japanese Patent Application No. 8-099150 filed Mar. 28, 1996, Japanese Patent Application No. 8-099151 filed Mar. 28, 1996, and Japanese Patent Application No. 8-154969 filed May 27, 1996 are hereby incorporated by reference.

What is claimed is:

1. A thermosensitive recording adhesive label comprising a support, a thermosensitive coloring layer provided on one side of said support, and a thermosensitive adhesive layer which is formed on the other side of said support, opposite to the side of said thermosensitive coloring layer with respect to said support, and is adhesive above room temperature, the surface of said thermosensitive coloring layer having a smoothness of 200 to 10,000 sec when measured by the method of Ohken-shiki prescribed in Japan Tappi No. 5, and the surface of said thermosensitive adhesive layer having a smoothness of 60 to 3,000 sec in terms of Bekk's smoothness.

2. The thermosensitive recording adhesive label as claimed in claim 1, wherein said thermosensitive adhesive layer comprises a polymeric resin which comprises at least an acryl-butadiene copolymer, and a plasticizer which assumes a solid state at room temperature.

3. The thermosensitive recording adhesive label as claimed in claim 1, further comprising a barrier layer which is provided between said support and said thermosensitive coloring layer and has an air permeability of 10,000 sec or more when measured by the method of Ohken-shiki prescribed in Japan Tappi No. 5.

4. The thermosensitive recording adhesive label as claimed in claim 1, further comprising a barrier layer which is provided between said support and said thermosensitive adhesive layer and has an air permeability of 10,000 sec or more when measured by the method of Ohken-shiki prescribed in Japan Tappi No. 5.

5. The thermosensitive recording adhesive label as claimed in claim 1, further comprising an insulating layer which is provided between said support and said thermosensitive coloring layer and comprises minute void particles with a voidage of 30% or more, said void particles comprising a thermoplastic resin for forming a shell for said void particles.

6. The thermosensitive recording adhesive label as claimed in claim 5, further comprising a barrier layer which is provided between said support and said thermosensitive adhesive layer and has an air permeability of 10,000 sec or more when measured by the method of Ohken-shiki prescribed in Japan Tappi No. 5.

7. The thermosensitive recording adhesive label as claimed in claim 5, further comprising a barrier layer which is provided between said support and said insulating layer and has an air permeability of 10,000 sec or more when measured by the method of Ohken-shiki prescribed in Japan Tappi No. 5.

8. The thermosensitive recording adhesive label as claimed in claim 1, further comprising an insulating layer which is provided between said support and said thermosensitive adhesive layer and comprises minute void particles with a voidage of 30% or more, said void particles comprising a thermoplastic resin for forming a shell for said void particles.

9. The thermosensitive recording adhesive label of claim 1, wherein one or more layers selected from the group consisting of a barrier layer and an insulating layer are interposed between at least one of:

a) said thermosensitive coloring layer and said one side of said support, or b) said thermosensitive adhesive layer and said other side of said support.

* * * * *